US005163459A

United States Patent [19]

Bailey

[11] Patent Number: 5,163,459

[45] Date of Patent: Nov. 17, 1992

[54] PAINT ROLLER COVER CLEANING APPARATUS

[75] Inventor: Warn Bailey, Perry, N.Y.

[73] Assignee: Brian Morgan, Sonyea, N.Y.

[21] Appl. No.: 817,289

[22] Filed: Jan. 6, 1992

Related U.S. Application Data

[63] Continuation-in-part of Ser. No. 736,000, Jul. 25, 1991, Pat. No. 5,086,796.

[51] Int. Cl.[5] ..... B08B 3/04

[52] U.S. Cl. ..... 134/182; 134/900

[58] Field of Search ..... 134/900, 117, 182, 183; 68/213

[56] References Cited

U.S. PATENT DOCUMENTS

| | | | |
|---|---|---|---|
| 4,377,175 | 3/1983 | Fritz | 134/900 X |
| 4,380,478 | 4/1983 | Cooney | 134/900 X |
| 4,957,127 | 9/1990 | Kostopoulos | 134/900 X |

*Primary Examiner*—Philip R. Coe
*Attorney, Agent, or Firm*—Howard J. Greenwald

[57] ABSTRACT

A paint roller cover applicator cleaning apparatus for cleaning a hollow, cylindrical paint roller cover is disclosed. The apparatus contains a cylindrical sleeve, a first end cap, a first plug connected to the first end cap, a second end cap, and a second plug connected to the second end cap. The apparatus also contains means for impeding the flow of liquid through the first end cap, the sleeve, and the second end cap.

14 Claims, 7 Drawing Sheets

FIG. 5
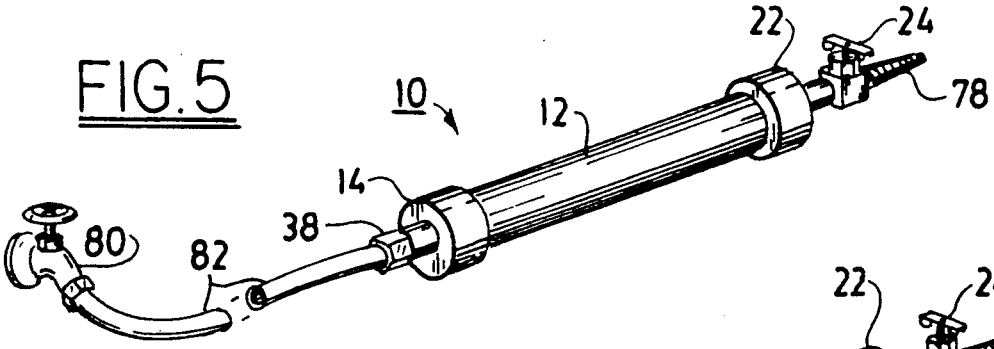
FIG. 6
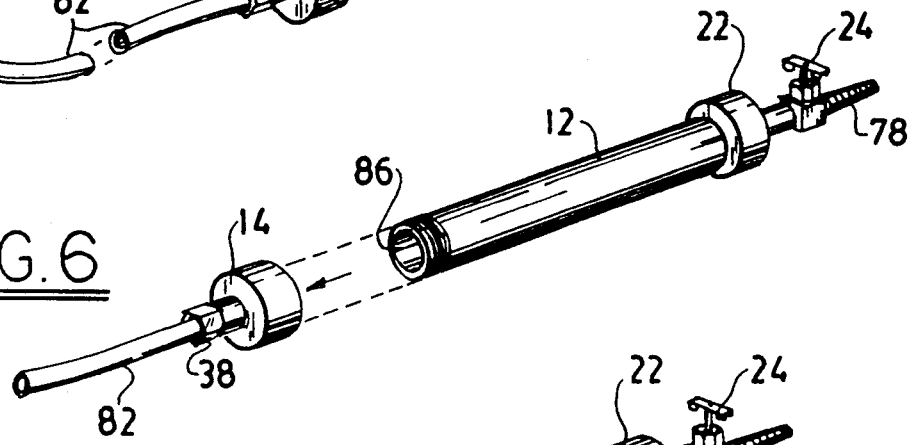
FIG. 7
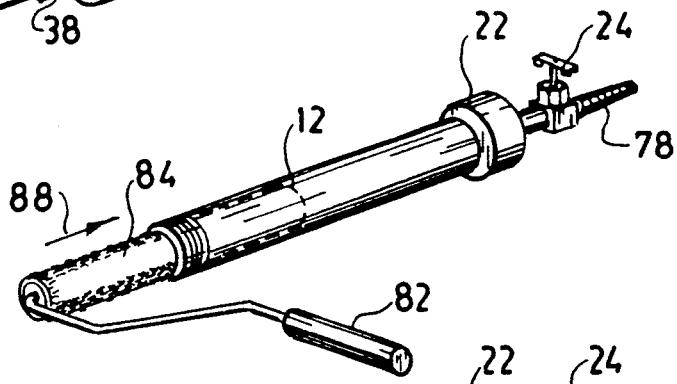
FIG. 8
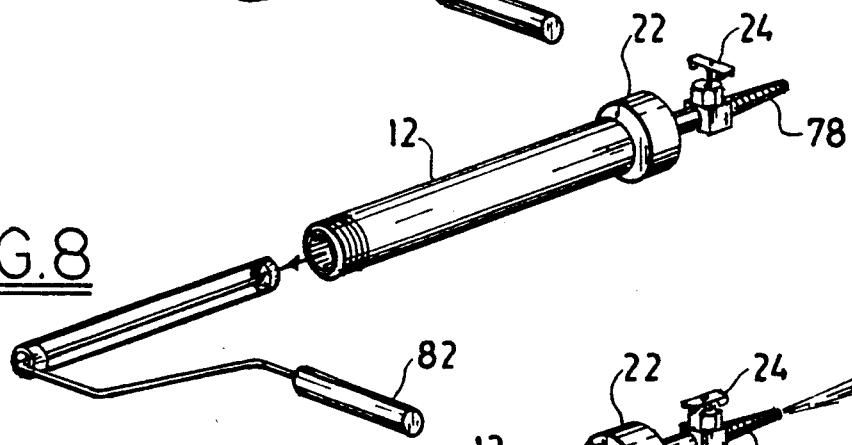
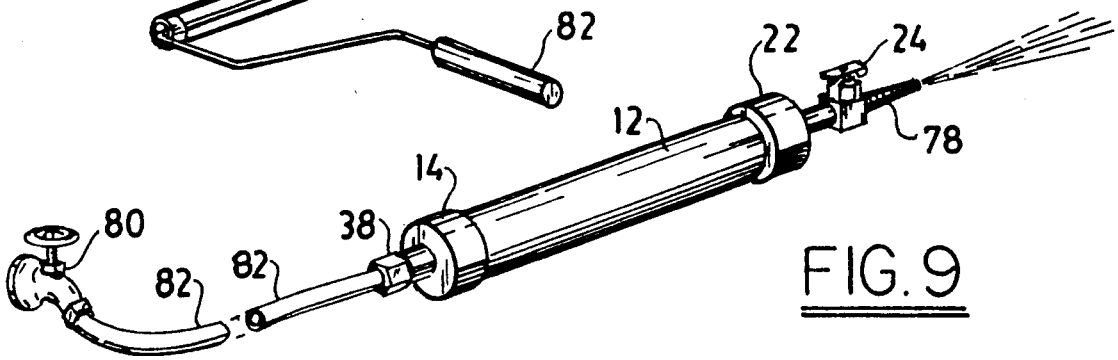
FIG. 9

PAINT ROLLER COVER CLEANING APPARATUS

CROSS REFERENCE TO RELATED PATENT APPLICATION

This is a continuation-in-part of applicant's copending U.S. patent application Ser. No. 736,000, and now U.S. Pat. No. 5,086,796.

FIELD OF THE INVENTION

An apparatus for cleaning the covers used in paint roller applicators.

BACKGROUND OF THE INVENTION

Paint rollers are widely used for painting surfaces. They are usually covered with a nap material which picks up and deposits the paint upon the surface to be painted.

Cleaning the cover for the paint roller applicator is a time-consuming and messy process. Thus, many attempts have been made to provide devices which will facilitate this cleaning.

In 1978, in his U.S. Pat. No. 4,126,484, Monteiro disclosed a device in which the entire roller with the applicator mounted thereon was inserted into a cylindrical body having an inside diameter of a size adapted to snugly and slideably receive the paint roller therein with a hook on the open end to hold the roller therein once it had been inserted. A liquid under pressure was admitted from the opposite end of insertion so that the liquid was forced through the nap of the cover mounted on the roller. As was noted in subsequent U.S. Pat. No. 4,957,127 (see column 1), the problem with Monteiro's approach " . . . is that the paint roller itself may not properly plug the ends of the cover applicators so that all of the liquid is not forced around the outer periphery of the cover. In addition, the discharge from the open end is only restricted by the complete open end of the cleaning cylinder and portions of the handle are in the way resulting in a very messy process with the polluted discharge water carrying the paint simply spews out of the complete open end of the cleaning cylinder."

In 1978, yet another attempt was made to provide a suitable paint roller cleaner. In his U.S. Pat. No. 4,155,230, Morgan D. Lacher, Jr. disclosed a device in which the cylindrical roller cover applicator of absorbent material fit snugly in a cylindrical casing with one end of the cylindrical roller cover applicator being plugged before the applicator which had been removed from its roller was inserted into the cylindrical casing; the other end of the applicator, as well as the cylindrical casing in which the applicator had been inserted, was closed with discharge openings communicating with the interior of the casing adjacent the inner periphery thereof. As was noted in subsequent U.S. Pat. No. 4,957,127 (see columns 1–2), the problem with Lacher, Jr.'s approach is that " . . . the end cap has a plurality of openings on the outer periphery thereof which receive the polluted water which is discharged around the entire end cap making for a difficult and messy discharge of polluted water. Then too, if any of the openings become clogged, the cleaning process is deterred. In addition, the end cap is required to plug one end of the paint applicator and to sod so it must be flush against the open end of the paint cover applicator or the pressure from the discharge water will enter the inside of the paint roller cover applicator weakening or destroying its tubular lining and/or depositing water containing paint on the interior of the tube which prevents a thorough cleaning job."

The disclosure of U.S. Pat. Nos. 4,126,484 and 4,155,230 are hereby incorporated by reference into this specification. In November of 1989, when the patent application from which U.S. Pat. No. 4,957,127 issued was filed, the prior U.S. Pat. Nos. 4,126,484 and 4,155,230 represented the state of the paint roller applicator cover cleaning art.

In his U.S. Pat. No. 4,957,127, George P. Kostsopoulos described a device which he alleged solved all of the problems of the prior art device. The device of this patent is a cylindrical paint roller cover applicator having a hollow body member supporting a paint-absorbing layer. This body member is plugged and inserted in the cleaning apparatus, which comprises a cylindrical sleeve having an inside diameter slightly smaller than the outside diameter of the applicator. A first end cap having a central opening therein is frictionally mounted on one end of the sleeve and has a central opening adapted to couple a water supply thereto. A coupler is frictionally mounted on the other end of the cylindrical sleeve which contains a bayonet socket which is adapted to removably house a second end cap having a plurality of bayonet studs equally spaced around the periphery which may be removably inserted and locked in the bayonet socket of the coupling. The second end cap has a central opening to which a discharge hose is connected.

However, the device disclosed in the Kostopoulos patent still presented some major problems. In the first place, when the cleaning apparatus of Kostopoulous is placed in a vertical position, it will not effectively clean the paint roller cover in a reasonable period of time. In the second place, the cleaning apparatus of Kostopoulous, even when placed in a vertical position, will not effectively clean the bottom of the paint roller cover. In the third place, the cleaning apparatus of Kostopoulous required the user to plug the ends of the roller before inserting it into the tube of his device. In the fourth place, the cleaning apparatus of Kostopoulous is not adapted to clean the cover of a paint power roller.

It is an object of this invention to provide an apparatus for cleaning a cover of a paint roller which may be effectively used in any position.

It is another object of this invention to provide an apparatus for cleaning a cover of a paint roller which does not require that a user plug the ends of the roller before inserting it into the tube of the apparatus.

It is yet another object of this invention to provide a a paint roller applicator cover cleaner which will effectively clean the cover of a power roller.

It is yet another object of this invention to provide all of the advantages of the device of U.S. Pat. No. 4,957,127 with none of the attendant disadvantages.

SUMMARY OF THE INVENTION

In accordance with this invention, there is provided an apparatus for cleaning the cover of a paint roller applicator. This apparatus contains a hollow body member and a spray ring disposed in one end of the body member. A plug is used at each end of the body member to keep the roller disposed in about the center of the body member.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIGS. 5 through 9 illustrate one preferred means of using applicant's cleaning device;

DESCRIPTION OF THE PREFERRED EMBODIMENTS

Figure 1:
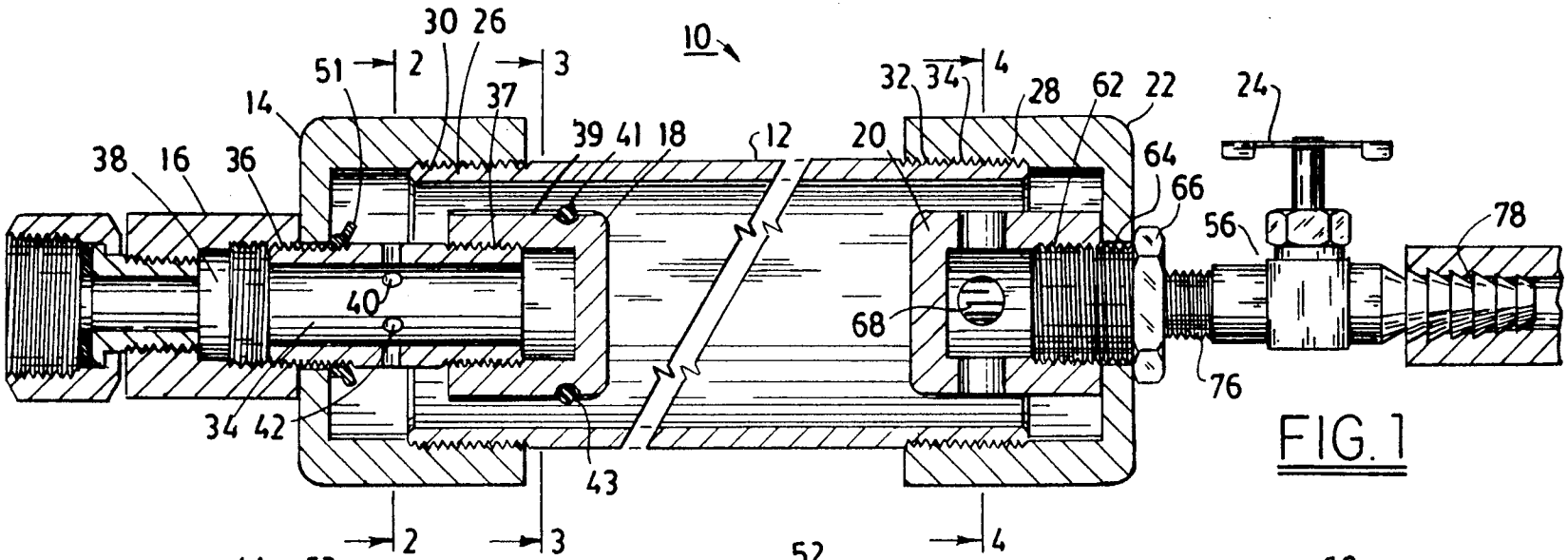
FIG. 1 is a sectional view of one preferred embodiment of applicant's cleaning apparatus.

FIG. 1 is a sectional view of one preferred embodiment of applicant's paint roller applicator cleaning apparatus 10. Referring to FIG. 1, it will be seen that cleaning apparatus 10 is preferably comprised of cylindrical sleeve housing 12, a first end cap 14, a means for providing a fluid spray 16, a plug 18, a plug 20, and a second end cap 22. In one embodiment, apparatus 10 also comprises a pressure valve 24.

Cylindrical sleeve housing 12 may be made out of any material which is commonly used for such housings. Thus, by way of illustration, such housing 12 may consist essentially of plastic, elastomeric material (such as rubber), soft metal, hard metal, and the like.

In one embodiment, it is preferred that cylindrical sleeve housing 12 be resilient. As is known to those skilled in the art, resilience is that property of a material by virtue of which it is able to do work against restraining forces during return from a deformed state; and resilient materials, consequently, resume their original positions after being bent, stretched, or compressed.

In one preferred embodiment, the resilient material used in sleeve housing 12 is a plastic material. In another preferred embodiment, the resilient material is an elastomers. Suitable plastic and elastomer materials are well known to those skilled in the art and are described in, e.g., "Modern Plastics Encyclopedia," the mid-October 1990 issue of Modern Plastics, Volume 67, Number 11.

In one embodiment, the cylindrical sleeve housing 12 is substantially rigid. In this embodiment, and/or the prior embodiment, sleeve housing 12 may be made out of plastic, rubber, metal, alloys, and the like.

Cylindrical sleeve housing 12 preferably has an inside diameter which is slightly smaller than the outside diameter of a paint roller applicator cover which is to be inserted therein and cleaned. It will be recognized by those skilled in the art that the naps of various paint roller applicator covers will vary depending upon the material of the nap. It will also be recognized by those skilled in the art that various paint roller applicators vary in length (from about 4 to about 18 inches), and thus the length of the cylindrical sleeve housing 12 also may also vary in length. When a shorter roller cover is to be used in a longer cylindrical sleeve 12, a "duck plug" may be used to position the cover so that it will be effectively cleaned while within the housing 12.

In the preferred embodiment illustrated in FIG. 1, the left and right ends of cylindrical sleeve housing 12 contain threads 26 and 28, respectively, to allow end caps 14 and 22 (which contain mating threads) to be mounted on sleeve housing 12. It will be appreciated by those skilled in the art that other means of removably connecting ends caps 14 and 22 to cylindrical housing 16 also may be used. Thus, e.g., one may use a friction fit. Thus, e.g., one may use the quick coupling means described in U.S. Pat. No. 4,957,127 which is comprised of a plurality of bayonet studs 40 coupled with a sloped passageway. Other means for coupling the cylindrical sleeve 12 with the end caps 14 and 22 also may be used.

Referring again to FIG. 1, end cap 14 is removably attached to one end of cylindrical sleeve housing 12, and end cap 22 is removably attached to the other end of cylindrical sleeve housing 12. In the embodiment illustrated in FIG. 1, each of end caps 14 and 22 has an internal diameter which is approximately equal to the external diameter of cylindrical sleeve housing 12. These end caps are preferably equipped with internal threads 30 and 32 which are designed to mate with the external threads 26 and 28 of cylindrical sleeve housing 12. As indicated before, other means of removably attaching end caps 14 and 22 to cylindrical sleeve housing 12 also may be used.

End caps 14 and/or 22 may be made from the material as cylindrical sleeve housing 12, or one or both of them may be made from different material.

In the preferred embodiment illustrated in FIG. 1, end cap 14 is comprised of an orifice in which is disposed spray assembly 34. In one preferred embodiment, spray assembly 34 is integrally joined to end cap 14. One end of spray assembly 34 contains attachment means, such as threads 36, water bib 38 may be attached to such end of the spray assembly. Water bib 38 may be any standard hose fitting equipped with a female connector. Thereafter, water bib 38 may be attached to a source of water.

The other end of spray assembly 34 also contains threads which allow such end to be connected to plug 18, which contains mating threads. As will be apparent to those skilled in the art, other means of connecting plug 18 and assembly 34 may be used.

Figure 2:
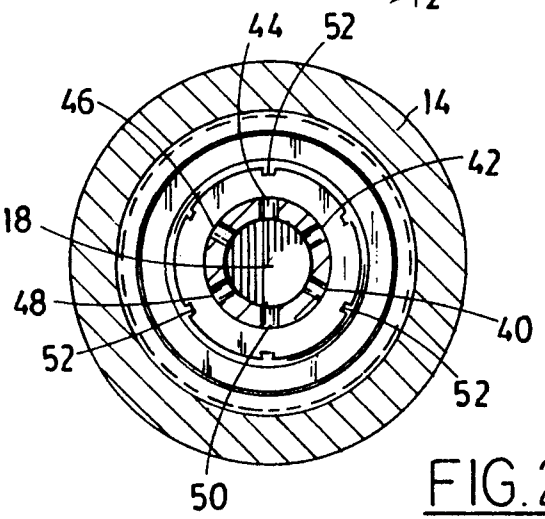
FIG. 2 is a sectional view of the cap used in the apparatus of FIG. 1, taken along lines 2—2.

In the preferred embodiment illustrated in FIGS. 1 & 2, 1, the exterior portion 39 of plug 18 contains a groove 52 which is adapted to receive an O-ring 43. O-ring 43 helps position the cover to be cleaned within cylindrical housing 12.

Referring again to FIG. 1, it will be seen that spray assembly 34 is comprised of a multiplicity of spray holes 40 and 42. Although only two spray holes are depicted in FIG. 1, it will be apparent to those skilled in the art that the assembly can (and preferably does) contain at least about 6 such spray holes. Thus, referring to FIG. 2, six such spray holes (42, 44, 46, 48, and 50) are shown in the sectional view.

Referring again to FIG. 1, spray assembly 34 is preferably positioned within end cap 14 with the assistance of washer 51; this washer preferably contains a flanged surface.

Spray assembly 34 may be constructed of the same or similar material as is used to construct cylindrical sleeve housing 12.

In one embodiment, not shown, annular grooves are cut into the end of plug 18. In this embodiment, the presence of such annular grooves will tend to facilitate the washing of the inside of the cover to be cleaned.

Figure 3:
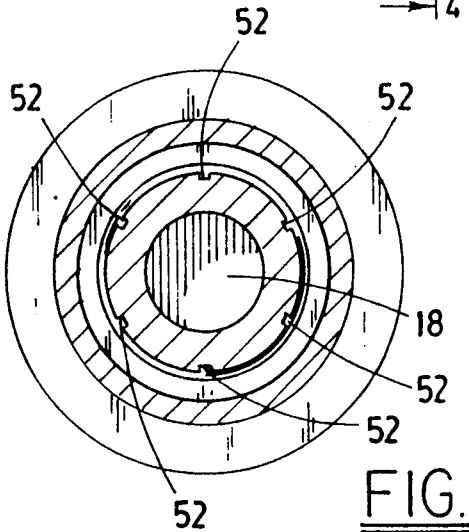
FIG. 3 is a sectional view of one plug used in the apparatus of FIG. 1, taken along lines 3—3.

FIG. 3 is a sectional view of the embodiment of FIG. 1, taken along lines 3—3.

Referring again to FIG. 1, it will be seen that end cap 22 is removably attached to the other end of cylindrical sleeve housing 12. In the embodiment illustrated in FIG. 1, each of end caps 14 and 22 has an internal diameter which is approximately equal to the external diameter of cylindrical sleeve housing 12. These end caps are preferably equipped with internal threads 30 and 32 which are designed to mate with the external threads 26 and 28 of cylindrical sleeve housing 12. As indicated before, other means of removably attaching end caps 14 and 22 to cylindrical sleeve housing 12 also may be used.

End cap 22 is comprised of an orifice in which is disposed pressure relief assembly 56. The pressure relief assembly, which allows one to vary the amount of fluid pressure within cylindrical housing 12, is comprised of plug 20 and pressure relief valve 24.

Plug 20 preferably contains internal threads 62 which are adapted mate with external threads 64 of 66. Fitting 66, in turn, is adapted to be connected to pressure relief valve 24, which also contains internal threads (not shown). It will be apparent to those skilled in the art that other means of connecting plug 20 to fitting 66 and/or fitting 66 to valve 24 may also be used.

Figure 4:
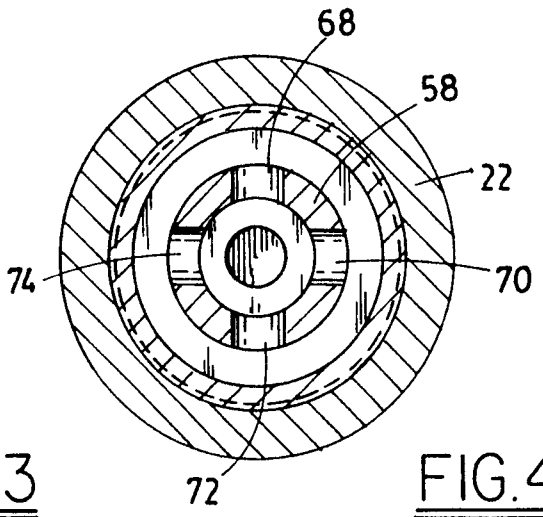
FIG. 4 is a sectional view of an end cap used in the apparatus of FIG. 1, taken along lines 4—4.

Plug 20 is comprised of a multiplicity of fluid drains, such as drain 68. As is shown in FIG. 4, which is a sectional view of plug 20, there are four such drains (68, 70, 72, and 74) in one embodiment. It is preferred that there be from about 1 to about 20 such drains in the assembly.

Cleaning fluid flowing through water bib 38 to plug 20 will tend to exit through one or more of drains 68, 70, 72, and 74 and, thereafter, flow through pipe 76. Thereafter, it will flow through valve 24 when valve 24 is in its open position. When, however, valve 24 is closed, pressure will tend to build up within cylindrical housing 12. When the pressure is released by opening valve 24, the rapid flow of cleaning fluid through housing 12 creates turbulence and tends to clean any cover situated within such housing.

Any means for restricting, preventing, allowing, or varying fluid flow may be used as valve 24. Thus, in one embodiment, a standard pressure valve is used.

The output from valve 24 may be fed through valve exit 78 to any suitable receptacle. Alternatively, one may connect such output to the input of another cleaning apparatus 10 to "daisy chain" such apparatuses. In such a manner, one may clean more than one cover at a time.

FIGS. 5 through 9 illustrate the operation of applicant's cleaning device 10. Referring to FIG. 5, a source of cleaning fluid (such as water) may be connected from spigot through hose 82 to water bib 38. In the position illustrated in FIG. 5, valve 24 is adjusted so that less than 100 percent of the maximum amount of water which could flow through said valve is allowed through the valve. Thus, for example, when only about 25 percent of the amount of water which could flow through housing 12 were such flow unimpeded is allowed to flow, a back pressure will build up within cylindrical housing 12.

FIGS. 6, 7, and 8 illustrate how the roller sleeve may be inserted into applicant's assembly 10. Referring to FIG. 6, end cap 14 may be unscrewed (or otherwise disconnected) form cylindrical housing 12. As will be apparent to those skilled in the art, this step should be conducted before water is connected to such assembly.

Referring to FIG. 7, a paint roller 82 comprised of a paint roller cover 84 may be positioned so that the paint roller cover 84 is aligned with the orifice 86 (see FIG. 6) of cylindrical housing 12. Thereafter, as the paint roller 82 is pushed in the direction of arrow 88, the paint roller cover is inserted into said orifice. The extent to which it can be inserted will be limited by plug 58 (not shown).

Referring to FIG. 8, once the paint roller cover 84 has been fully inserted into orifice 86 to substantially the maximum extent possible, the paint roller may be withdrawn in the direction of arrow 88, thereby leaving the paint roller cover 84 within orifice 86.

Referring to FIG. 9, the end cap 14 is then reconnected, water bib 38 is connected and then attached to a source of water, the valve 24 is adjusted so that less than 100 percent of the maximum water flow will occur, the water is turned on, back pressure is allowed to build up within assembly 10, and then valve 24 is adjusted so that it does not restrict water flow. Once such adjustment has been made, fluid turbulence occurs within cylindrical housing 12, and cleaning of cover 84 occurs.

It will be apparent to those skilled in the art that other means of varying and/or restricting the flow of water through cylindrical housing 12 may be used in place of valve 24. Thus, by way of illustration, one may use an outflow tube smaller than the inflow tube.

Figure 10:
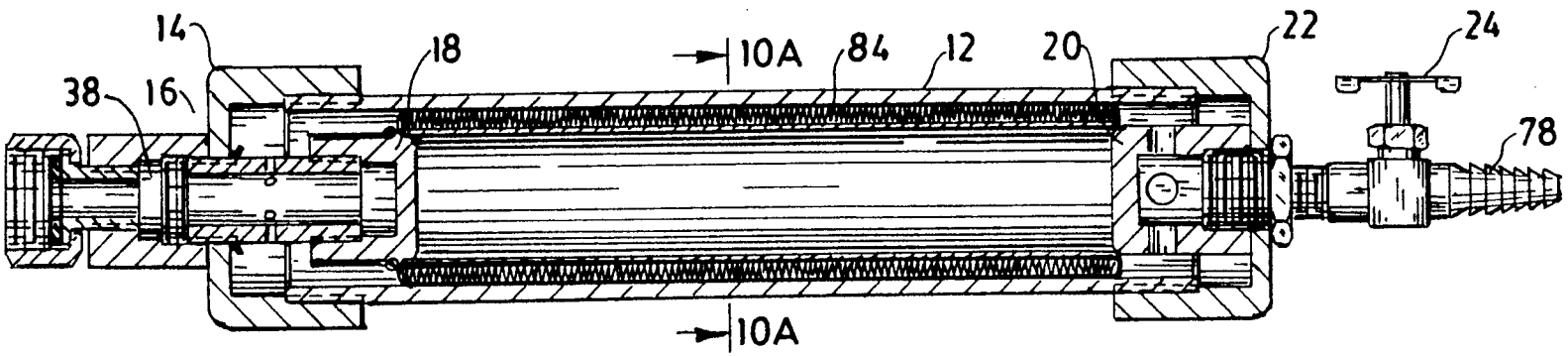
FIG. 10 illustrates the apparatus of FIG. 1 with a paint roller cover disposed therein.
Figure 10A:
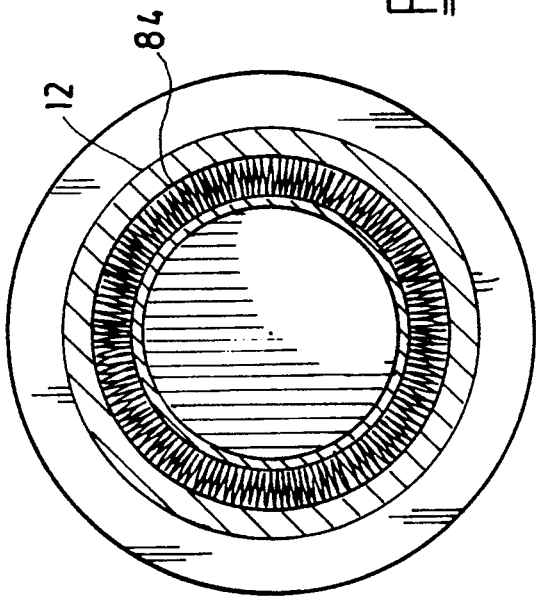
FIG. 10A is a sectional view through the middle of the apparatus of FIG. 10.

FIG. 10 is a cross-sectional view of applicant's cleaning device with a cover 84 disposed therein. Referring to FIG. 10, it will be seen that cover 84 can be maintained in position within cylindrical housing 12 by the use of O-ring 43, and plugs 20 and 18.

Figure 11:
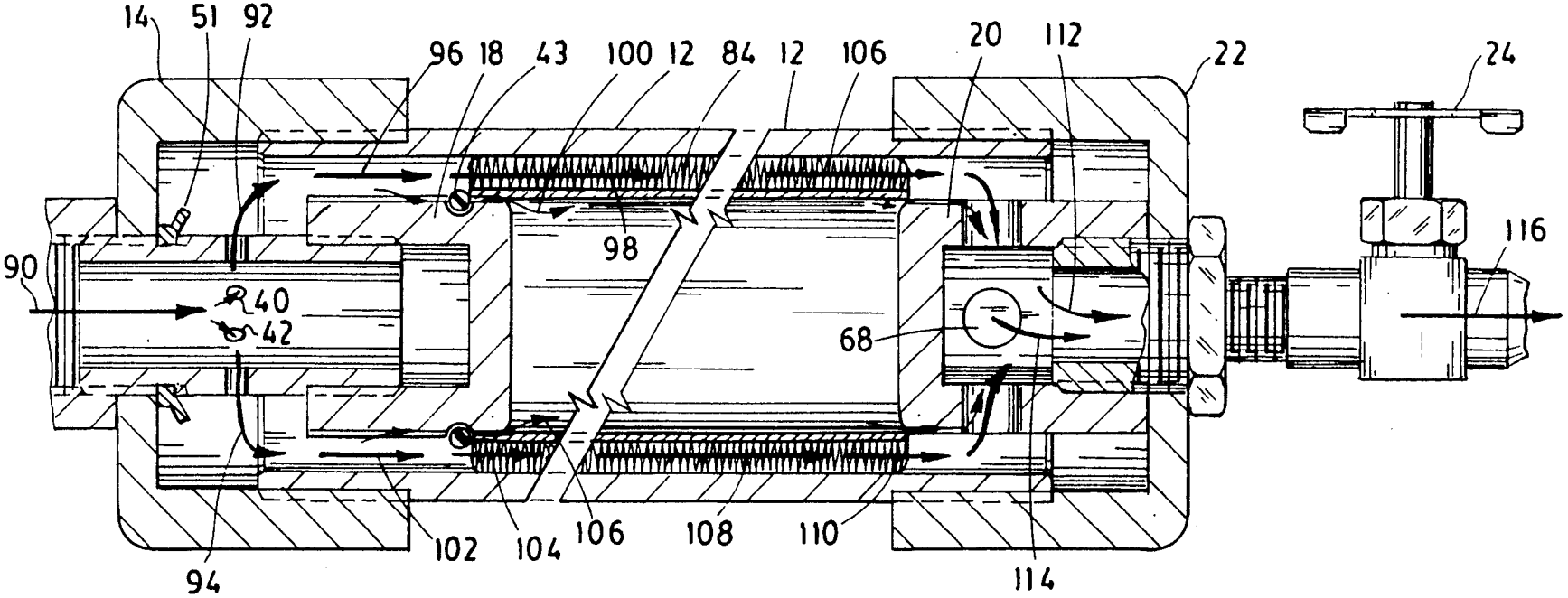
FIG. 11 illustrates the flow of cleaning fluid within the apparatus of FIG. 10.

FIG. 11 illustrates the pattern of cleaning fluid (water) flow through device 10. Referring to FIG. 11, it will be seen that fluid flows from the spigot (not shown) in the direction of arrow through spray ring 34 and out of spray holes 40 and 42, in the directions of arrows 92 and 94.

The fluid flowing through the top of the assembly will flow in the direction of arrow 96 and then, once it passes O-ring 43, will divide into two streams, one going through the nap of cover 84 in the direction of arrow 98, and the other going in the direction of arrow 100 on the inside of the cover. By the same token, the fluid flowing through the bottom of the assembly will flow in the direction of arrow 102 and then, once it passes O-ring 43, will divide into two streams, one going through the nap of cover 84 in the direction of arrow 104, and the other going in the direction of arrow 106 on the inside of the cover. Thus, applicant's design allows cleaning of both the inside and the outside of the paint roller cover.

It will be apparent to those skilled in the art that applicant's plugs 18 and 20 serve mainly to position roller cover 84 within the cylindrical housing 12. However, the plugs are not so tightly in contact with cover 84 that water flow through the inside of the cover is prevented.

Referring again to FIG. 11, water continues to flow in the directions of arrows 106, 108, and 110 until the water contacts drains 68, 70, 72, and 74, which contact will cause the water to tend to exit via such drains when valve 24 is opened and thence to exit towards valve 24 in the direction of arrows 112 and 114. Thereafter, the water will exit valve 24 in the direction of arrow 116.

Figure 12:
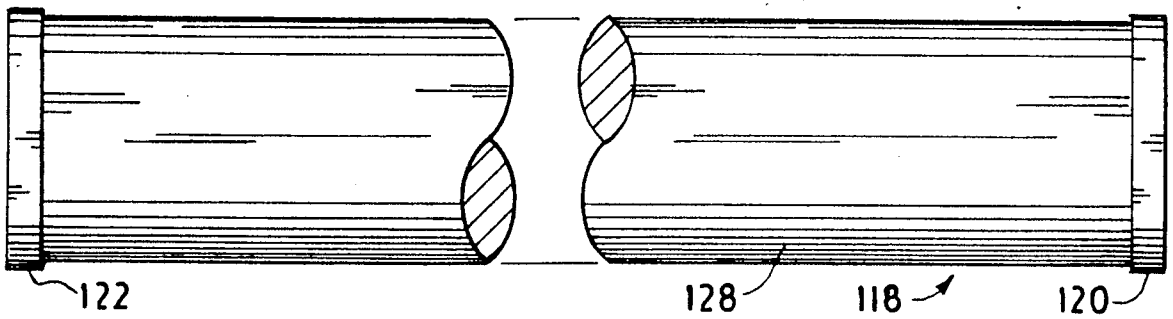
FIG. 12 illustrates a plug which, when used in combination with a cover for a power roller, may be used to clean such power roller.
Figure 13:
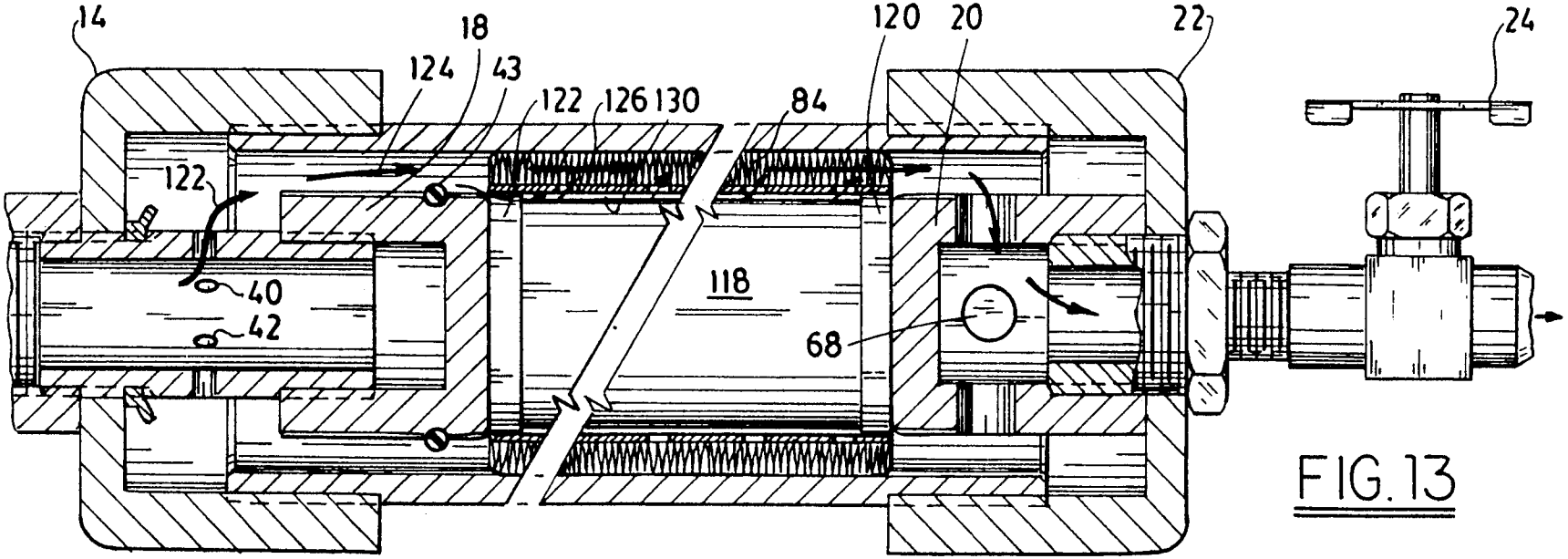
FIG. 13 illustrates the plug of FIG. 12 and a power roller cover disposed within applicant's cleaning device.

FIGS. 12 and 13 illustrate one preferred embodiment of applicant's invention, which may be used to clean cover for power rollers. As is known to those skilled in the art, these covers are generally perforated. Thus, in this embodiment, a cylindrical plug adapted to fit within the interior of the cover is utilized.

Referring to FIG. 12, plug 118 is shown. The plug 118 has two end portions 120 and 122 of increased diameter. Once the plug has been inserted within the cover, end portions 120 and 122 tend to prevent water from flowing into the ends of the cover.

FIG. 13 illustrates the flow of water in the process of cleaning the power roller cover, which is disposed around plug 118. Water tends to travel in the direction of arrows 122 and 124 until it contacts increased diameter section 122 of plug 118. Thereafter, because this increased diameter section 122 will tend to prevent water from flowing inside the cover 84, the water will flow in the direction of arrow 126.

Referring again to FIG. 12, plug 118 has a decreased diameter section 128. Because of this decreased diameter section, there is a space 130 between the inside of cover 84 and plug 118, and water may flow back and forth through the perforations (not shown) in cover 84, thereby cleaning both the inside and the outside of cover 84. Thereafter, the water flows as indicated before.

DESCRIPTION OF ANOTHER PREFERRED EMBODIMENT

FIGS. 14–19 describe another preferred embodiment of applicant's invention which differs from the embodiment of FIGS. 1–13 in several respects. The latter embodiment, of FIGS. 14–19, does not contain a spray assembly 34, nor does it contain pressure relief assembly 56. Plugs 18 and 20 have been modified in structure and/or location so that elements 34 and 56 are not needed in the new device.

Figure 14:
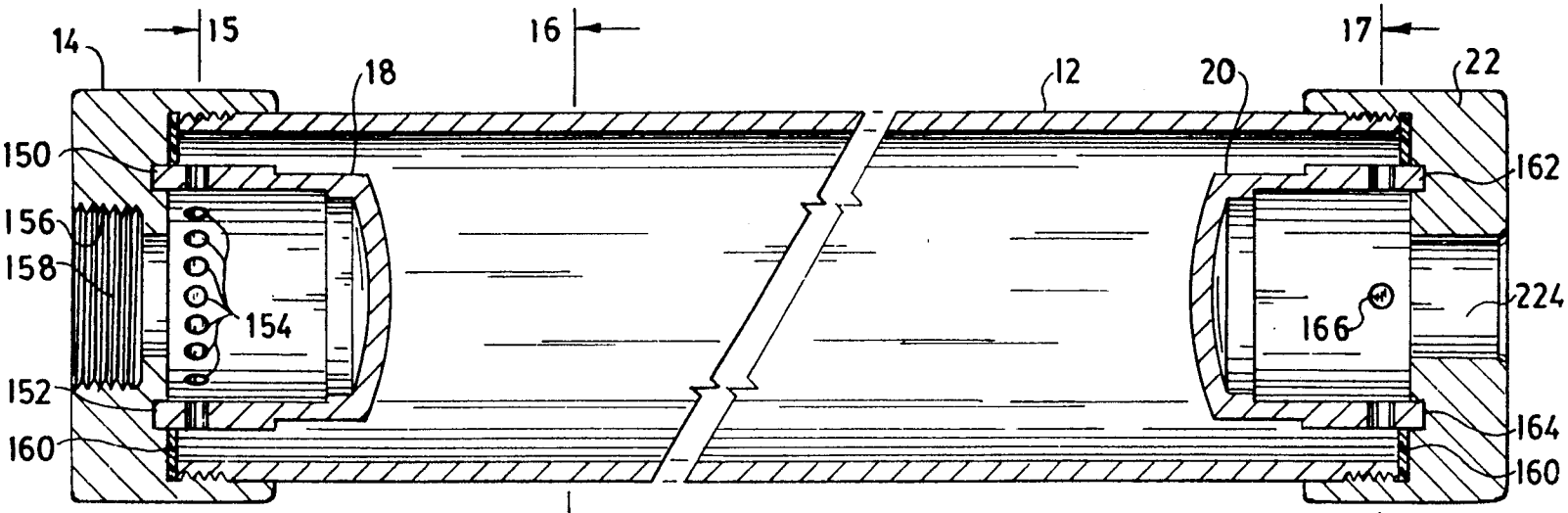
FIG. 14 is a side sectional view of another preferred embodiment of applicant's cleaning device.

Referring to FIG. 14 it will be seen that plug 18 is now adjacent to the interior wall of end cap 14, being disposed within an annular groove 150 which is formed within said interior wall. It is preferred to attach the end 152 of plug 18 to said interior wall by conventional adhesive means.

Referring again to FIG. 14, it will be seen that plug 18 is comprised of a multiplicity of orifices which are adapted to allow the flow of liquid through them. As will be seen by reference to FIG. 15, and in the embodiment depicted therein, there are sixteen such orifices 154.

Referring again to FIG. 14, it will also be seen that end cap 14 is comprised of a multiplicity of interior threads 156 which are disposed around orifice 158. The threaded opening 158 allows one to connect the male adaptor of a suitable water source (such as, e.g., a garden hose) to end cap 14.

In the preferred embodiment illustrated in FIG. 14, it is preferred to dispose an annular elastomeric gasket 160 between end cap 14 and cylindrical sleeve 12 to help make the assembly water-tight. A similar gasket 160 is preferably disposed between end cap 22 and cylindrical sleeve 12 at the other end of the device.

Referring again to FIG. 14, it will be seen that, in the embodiment depicted therein, plug 20 is now contiguous with end cap 22, its end 162 being disposed within an annular groove 164 formed within the interior surface of said end cap 22. It is also preferred to join plug 20 to end cap 22 by adhesively joining its end 162 to end cap 22 within the annular groove 164.

Figure 17:
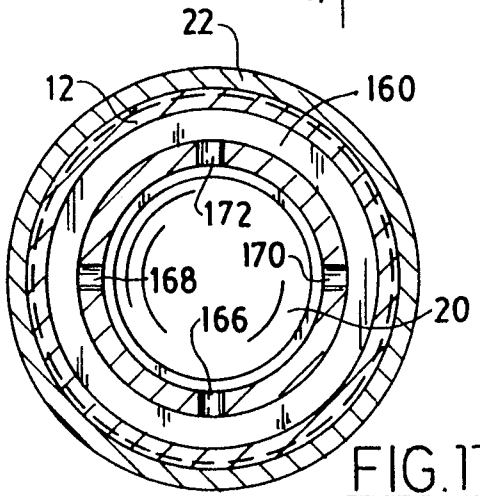
FIGS. 15, 16, and 17 are each sectional views of the cleaning device of FIG. 14, taken along lines 15—15, 16—16, and 17—17, respectively.
Figure 16:
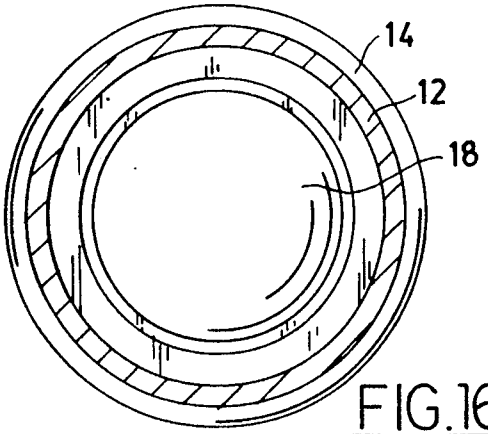
Figure 15:
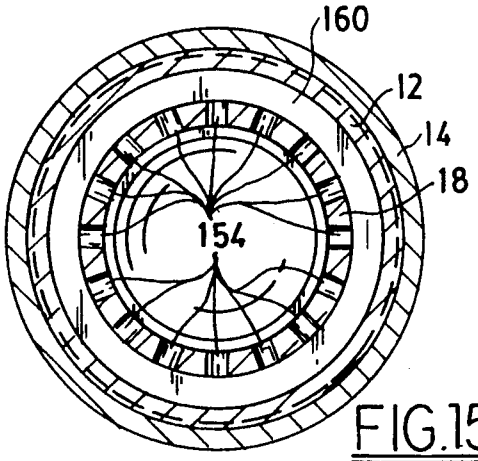

Plug 20 also is comprised of a multiplicity of orifices. One such orifice, orifice 166, is illustrated in FIG. 14. In this embodiment, however, as is illustrated in FIG. 17, it is preferred to utilize four such orifices, orifices 166. 168, 170, and 172.

In the embodiment illustrated in FIG. 14, the cross-sectional surface area of the orifices in plug 20 is substantially less than the cross-sectional surface area of the orifices 154 in plug 18.

It is preferred to have from 2 to about 64 orifices 154 disposed around the perimeter of plug 18, and to have from about 2 to about 64 orifices disposed around the perimeter of plug 20. It is preferred that, in each such plug, each orifice be substantially the same size; however, different sized orifices may be used.

What is essential, however, is that the total cross-sectional area defined by the orifices in plug 20 be from about 0.1 to about 0.75 times as great as the cross-sectional area defined by the orifices in plug 18. It is even more preferred that the total cross-sectional area defined by the orifices in plug 20 be from about 0.15 to about 0.35 times as great as the cross-sectional area defined by the orifices in plug 18. In an even more preferred embodiment, the total cross-sectional area defined by the orifices in plug 20 be from about 0.15 to about 0.25 times as great as the cross-sectional area defined by the orifices in plug 18. In the most preferred embodiment, the total cross-sectional area defined by the orifices in plug 20 is about 0.20 times as great as the cross-sectional area defined by the orifices in plug 18.

Figure 18:
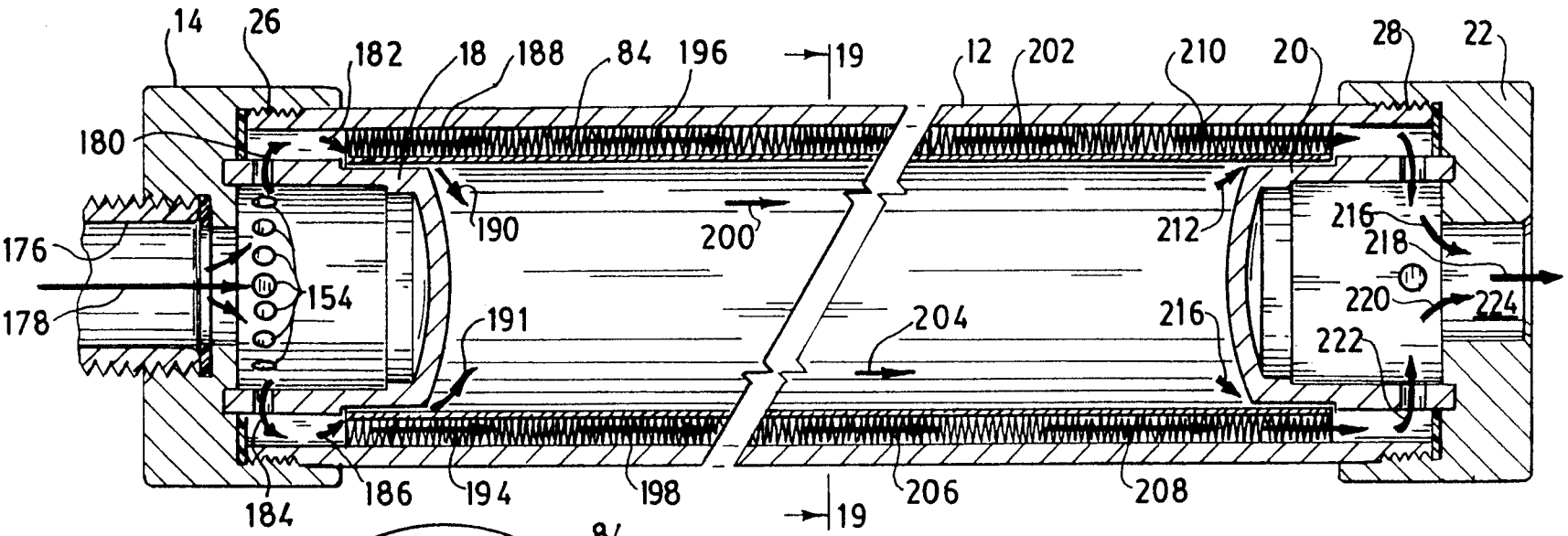
FIG. 18 is another side sectional view of the cleaning device of FIG. 4, illustrating the flow of water through it.
Figure 19:
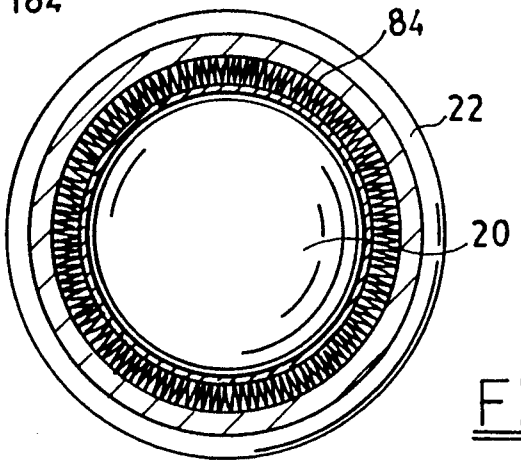
FIG. 19 is a sectional view of the device of FIG. 18, taken through lines 19—19.

FIG. 18 is a cross-sectional view of the device of FIG. 14 with a paint roller cover 84 disposed within it, between cylindrical wall 12 and plugs 18 and 20.

In the embodiment depicted in FIG. 18, water is introduced into the system through fitting 176 in the direction of arrow 178. The water then exits through orifices 154 and then travels in the directions of arrows 180, 182, 184, 186, 188, 190, 192, 194, 196, 198, 200, 202, 204, 206, 208, 210, 21, and 214 through, on, around, and under paint roller cover 84.

The water passing through the cylindrical sleeve 12 eventually encounters one or more portions of plug 20. It is allowed to exit sleeve 12 by passing through one or more of the orifices in plug 20; however, because of the reduced total surface area of these orifices, its ability to flow through the orifices is redueed.

The water flowing out of sleeve 12 passes in the direction of arrows 216, 218, 220, and 222 through orifice 224.

In another emboiment, not shown, the water flow through end cap 20 is restricted not by provided orifices with less total surface area in plug 20, but by providing an orifice 224 with reduced cross-sectional area. In yet another embodiment, a combination of reducing the total surface area in the orificies in plug 20 and in reducing the cross-sectional area of orifice 224 is used.

It will be apparent to those skilled in the art that many other means may be used to reduce the flow rate of the water so that the flow rate of the water exiting orifice 224 is from about 0.1 to about 0.75 times as great as the flow rate of the water entering endcap 14. These other means are within the scope of the invention.

It is to be understood that the aforementioned decription is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A paint roller cover applicator cleaning apparatus for cleaning a hollow, cylindrical paint roller cover applicator of the type having a hollow body member supporting a paint absorbing layer, comprising:

(a) a cylindrical sleeve housing having an inside diameter slightly smaller than the outside diameter of a paint roller cover applicator to be cleaned by the apparatus and means for introducing fluid into said cylindrical sleeve housing;

(b) a first end cap having a first central opening therein, wherein said first end cap is connected to a first end of said sleeve;

(c) a first, substantially cylindrical plug which is connected to said first end cap, wherein said first plug is comprised of from about 2 to about 64 orifices;

(d) a second end cap having a second central opening therein, wherein said second end cap is connected to a second end of said sleeve;

(e) a second, substantially cylindrical plug which is connected to said second end cap, wherein said second plug is comprised of from about 2 to about 64 orifices; and (f) means for impeding the flow of fluid through said cylindrical sleeve such that fluid will flow through said second central opening at a flow rate which is from about 0.1 to about 0.75 times as great as the flow rate of water flowing through said first central opening.

2. The cleaning apparatus as recited in claim 1, wherein said cylindrical sleeve consists essentially of plastic material.

3. The cleaning apparatus as recited in claim 1, wherein said cylindrical sleeve consists essentially of resilient material.

4. The cleaning apparatus as recited in claim 1, wherein said cylindrical sleeve consists essentially of elastomeric material.

5. The cleaning apparatus as recited in claim 1, wherein said cylindrical sleeve consists essentially of metal.

6. The cleaning apparatus as recited in claim 1, wherein an annular elastomeric ring is disposed between said first end cap and said first end of said sleeve.

7. The cleaning apparatus of claim 6, wherein an annular elastomeric ring is disposed between said second end cap and said second end of said sleeve.

8. The cleaning apparatus of claim 1, wherein said first plug is comprised of about 16 orifices.

9. The cleaning apparatus as recited in claim 8, wherein said second plug is comprised of about 4 orifices.

10. The cleaning apparatus as recited in claim 9, wherein each of the orifices in said first plug has substantially the same cross-sectional area.

11. The cleaning apparatus as recited in claim 10, wherein each of the orifices in said second plug has substantially the same cross-sectional area.

12. The cleaning apparatus as recited in claim 11, wherein said cylindrical sleeve consists essentially of plastic material.

13. The cleaning apparatus as recited in claim 1, wherein said first end cap consists essentially of plastic material.

14. The cleaning apparatus as recited in claim 13, wherein said second end cap consists essentially of plastic material.

* * * * *